US006612243B1

(12) United States Patent
Italiane et al.

(10) Patent No.: US 6,612,243 B1
(45) Date of Patent: Sep. 2, 2003

(54) FIRE EXTINGUISHER

(75) Inventors: John R. Italiane, Seattle, WA (US); Nicholas R. Arnot, Woodinville, WA (US); Gary F. Holland, Snohomish, WA (US)

(73) Assignee: Aerojet - General Corporation, Redmond, WA (US)

( * ) Notice: Subject to any disclaimer, the term of this patent is extended or adjusted under 35 U.S.C. 154(b) by 0 days.

(21) Appl. No.: 10/085,884

(22) Filed: Feb. 27, 2002

Related U.S. Application Data

(60) Provisional application No. 60/271,773, filed on Feb. 27, 2001.

(51) Int. Cl.[7] ..... F42B 12/46
(52) U.S. Cl. ..... 102/367
(58) Field of Search ..... 102/367; 169/12, 169/35, 58, 62, 84

(56) References Cited

U.S. PATENT DOCUMENTS 3,482,637 A * 12/1969 Mitchell et al. ..... 169/45
3,833,063 A * 9/1974 Williams ..... 169/45
3,881,420 A * 5/1975 Smith et al. ..... 169/28
H141 H * 10/1986 Finnerty et al. ..... 102/334
5,088,560 A * 2/1992 Fawal ..... 169/28
5,115,867 A * 5/1992 Tyler ..... 169/28
5,884,710 A * 3/1999 Barnes et al. ..... 169/28
6,161,624 A * 12/2000 Bennett ..... 169/46

* cited by examiner

*Primary Examiner*—Charles T. Jordan
*Assistant Examiner*—Bret Hayes
(74) *Attorney, Agent, or Firm*—Todd E. Garabedian; Wiggin & Dana LLP

(57) ABSTRACT

An apparatus for fire suppression may include a flexible container, a gas generant or other suppressant, initially located within the flexible container, and an initiator. A propagating member may be located within the container to permit the initiator to initiate the generant or expel the other suppressant upon triggering of the initiator to extinguish the fire. A sustainer may be provided to sustain the suppression and may be positioned within a generator housing upstream of the propagating member or at or adjacent the downstream end of the propagating member.

26 Claims, 10 Drawing Sheets

FIRE EXTINGUISHER

CROSS-REFERENCE TO RELATED APPLICATION

This patent application claims priority of U.S. Provisional Patent Application Serial No. 60/271,773 entitled "FIRE EXTINGUISHER" that was filed on Feb. 27, 2001, the disclosure of which is incorporated by reference in its entirety herein.

BACKGROUND OF THE INVENTION (1) Field of the Invention

This invention relates to gas generation, and more particularly to gas generation systems useful for fire or explosion suppression purposes.

(2) Description of the Related Art

Rapid deflagrating cord (RDC), sometimes erroneously identified as rapid detonating cord has been in common use in the explosives industry as a transfer line for igniting explosives. Detonating cord (detcord) has been used extensively as a transfer line and as an explosive (e.g., for cutting structural elements). Both RDC and detcord comprise a sheath containing an explosive (commonly identified as a "pyrotechnic" in the case of RDC). Detcord typically comprises a plastic or cloth sleeve containing a high explosive charge. When ignited at one end, detcord bums via propagation of a detonating shock wave. The shock wave moves through the explosive at a velocity greater than the speed of sound in the explosive (nearly always in excess of about 2000 m/s and typically 5000–7000 m/s) and ignites the unreacted explosive through which it passes. With RDC, burning is via deflagration, a high velocity subsonic propagation (typically less than 2000 m/s). With RDC, thermal energy is transferred from the reacted explosive to the unreacted explosive primarily via conduction. With detcord and RDC, the combustion involves self-contained oxygen in the explosive charge.

RDC has been used as a component in gas generators. RDC can typically be ignited via the output of a conventional automotive airbag initiator (e.g., one containing a charge of 35 mg zirconium potassium perchlorate (ZPP) or its equivalent). The output of such an initiator is not reliably capable of directly igniting detcord. Detcord requires a detonator to provide the initial energy necessary to induce ignition of the detcord.

U.S. Pat. No. 6,062,143 of Grace et al. identifies a distributed charge inflator (DCI). The application identifies use of an electronic squib (commonly used in automotive airbag inflators) to ignite a core of ignition material such as RDC or mild detonating fuse (MDF). The presence of a gas-generating layer or coating on the core is also identified.

U.S. Pat. No. 5,967,550 of Shirk et al. identifies a staged pyrotechnic air bag inflator. A housing defines a chamber with an end-burning pyrotechnic charge. The charge has a first predetermined burn rate at a first location along the length of the chamber and a different second predetermined burn rate at a second location along the length of the chamber spaced apart from the first location. The second burn rate may be effective to maintain inflation of the air bag over a desired interval.

U.S. Pat. No. 5,224,550 of Bragg identifies an explosion suppression system in which a suppressant is contained within dispersion tubes and is expelled responsive to combustion of an ignition cord.

BRIEF SUMMARY OF THE INVENTION

International Application PCT/US00/30726 (PCT '726) of Primex Aerospace Company et al. discloses a number of embodiments of a gas generator. The disclosure of PCT/US00/30726 is incorporated by reference herein as if set forth at length. These and other distributed gas generation systems are believed useful in fire suppression. In particular, such systems may be useful in providing a distributed release of fire suppressant.

The suppressant may be in the form of inert combustion gases. The gases may be from charges of primary and secondary propellant-type suppressant agents, for respectively knocking down and sustaining inertion of a fire or explosion. The suppressant may be in the form of a liquid or solid suppressant agent expelled from the extinguisher by an ignition cord.

Key extinguishers have flexible bodies containing at least the primary suppressant. The bodies may extend terminally from a single rigid end fixture or may extend between two end fixtures. An end fixture may contain an initiator and may also contain a secondary sustainer propellant/suppressant charge.

The extinguishers may be deployed and used via various methods. Key methods involve flexing or forming the bodies to conform to a mounting situation and then securing the deformed extinguisher to environmental structure.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
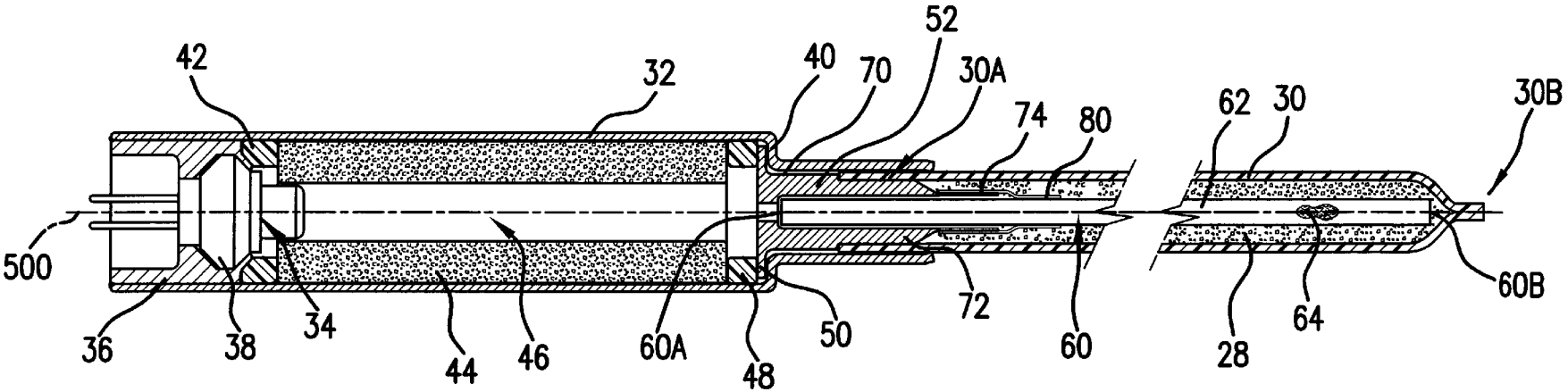
FIG. 1 is a longitudinal cross-sectional view of a first extinguisher according to principles of the invention.
Figure 2:
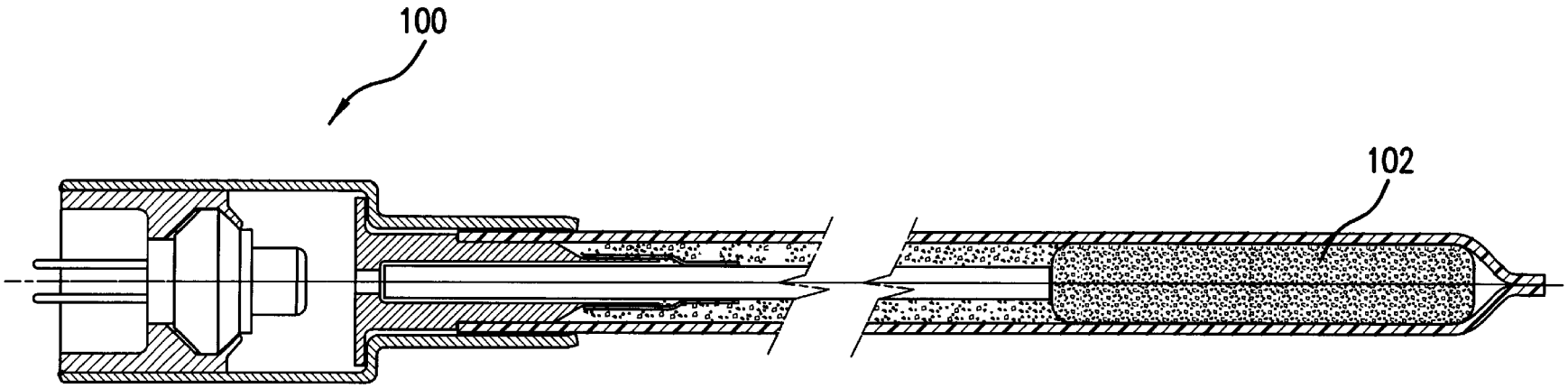
FIG. 2 is a longitudinal cross-sectional view of a second extinguisher according to principles of the invention.

FIGS. 1 and 2 show concepts for a flexible distributed charge fire extinguisher, particularly useful for fire suppression in enclosed spaces with little free volume. Examples of such spaces include telecommunication cabinets, compartments in vehicles, and the like where free volume is a premium and the ease of installation provided by an elongate flexible or formable structure is highly useful. The extinguisher design uses a initiator that ignites an ignition cord that combusts or disperses a primary agent to extinguish a fire. An optional secondary agent can be provided to keep the fire extinguished and prevent re-ignition. The secondary charge typically has a slower, longer duration agent release and may be of similar construction to the sustainer generant identified in PCT/US00/30726. Except as noted, reference numerals identify components that may be similar to those of the PCT '726 application.

In the exemplary embodiment of FIG. 1, the apparatus includes a primary gas generating propellant 28 contained within an elongate flexible member 30 such as a polymeric or metallic tube. The tube 30 has an upstream or proximal end 30A coupled to a downstream end of an initiator housing body 32 and extends to a closed downstream or distal end 30B. An exemplary tube is formed of a plastic such as crosslinked polyethylene, its downstream end closed via a pinch and heat seal operation. The apparatus has a centerline 500 along which the downstream direction is defined from the housing body 32 toward the tube distal end 30B. At its upstream end, the housing body 32 carries an initiator 34 by means of an initiator housing end plug 36. In the exemplary embodiment of a disposable apparatus, the body 32 and end plug 36 are formed of stainless steel. A flange portion 38 of the initiator 34 is crimped within a downstream compartment in the end plug. An exterior cylindrical surface of the end plug is received by and contacts an interior cylindrical surface of the body 32. The end plug may be secured to the body such as by welding along aligned upstream rims of the two. Stainless steel for the housing is preferred due to its strength and corrosion resistance. Stainless steel is preferred for the plug due to corrosion resistance and weld compatibility with the housing. Alternatively, an aluminum plug may be crimped or otherwise secured to the housing.

A downstream end portion (neck) of the exemplary housing body is of reduced diameter relative to the upstream portion and separated therefrom by an annular radially-extending flange forming a shoulder 40. From upstream to downstream sandwiched between a downstream surface of the end plug 36 and the shoulder 40 are: an upstream annular elastomeric foam ring 42; an annular tube 44 of sustainer propellant having a central longitudinal channel or aperture 46; a downstream annular elastomeric foam ring 48; and an upstream radially-extending flange 50 of a ferrule 52. The rings 42 and 48 serve as pads, holding and supporting the annular tube 44 of sustainer propellant under slight longitudinal compression. As an alternative to the rings, other compliant or compressible means may be used such as steel wool, belleville washers, coil springs, and the like.

In the illustrated embodiment, an operative end or charge cup portion of the initiator extends slightly within an upstream end portion of the sustainer. An exemplary initiator may take the form of a squib having a general construction commonly utilized in automotive airbag applications. Within a plastic body, the squib contains a small explosive charge (not shown) and has electrical leads for connecting the charge to an external control circuit. When an appropriate voltage is applied to the leads, the charge is ignited. Examples of such initiators are the LCI initiator of Quantic Industries, Inc. of San Carlos, Calif. and products of Special Devices, Inc. of Newhall, Calif. If required, a more robust initiator having a threaded metal body (e.g., manufactured according to United States Military Standard I-23659) may be used.

Concentrically within the tube is carried an ignition propagating member 60 extending from an upstream end 60A to a downstream end 60B. An exemplary propagating member is rapid deflagrating cord having a sheath 62 (e.g., of tin having an outer diameter of about 1.5–1.7 cm) and a pyrotechnic or an explosive 64 contained within the sheath. In the exemplary embodiment, the cord upstream/proximal end 60A is located near but slightly downstream of the downstream end of the sustainer. The cord is thus spaced significantly apart from the initiator charge cup. Advantageously, the initiator charge is effective to initiate combustion of the propagating member and of the sustainer. This may require the presence of a relatively large initiator charge or the addition of a transfer charge to transfer output of the initiator to the propagating member. This need can be reduced somewhat by extending the propagating member through the sustainer into close proximity with the initiator. However such a configuration may cause damage to the sustainer from the combustion of the propagating member.

The upstream cord end 60A is received by and held within a counterbored central aperture in the ferrule 52. A first portion 70 of the ferrule extends forward from the flange 50 largely within the downstream neck portion of the housing. The diameter of the portion 70 advantageously provides a slight clearance between its outer surface and the inner surface of the housing neck. A more downstream second ferrule portion 72 has a further reduced diameter. The portion 72 is surrounded by an upstream end portion of the tube. The tube wall thickness is advantageously greater than the difference between the external radii of the portions 70 and 72, permitting the tube to be compressed between the inner surface of the neck and the outer surface of the portion 72. A third ferrule portion 74 further downstream and of substantially reduced diameter is separated from the portion 72 by a bevel approximately coaligned with the downstream rim of the housing. The bevel allows the housing to be crimped radially inward at the rim, providing robust engagement between the housing and the tube. The portion 74 extends to a downstream rim of the ferrule and is surrounded by a length of heat shrink tubing 80 extending forward therefrom and surrounding an adjacent portion of the propagating member. The tubing 80 provides a seal between the annular propellant-carrying space between the tube and propagating member on the one hand and the interior of the housing on the other. Since, in the illustrated embodiment, the ferrule is totally sealed within the housing and tube, environmental exposure is less of a concern. Accordingly, it may be formed of a carbon steel instead of stainless steel or another more corrosion resistant metal.

Advantageously, the tube 30 and propagating member/cord 60 are highly flexible, permitting them to conform to a desired shape within the space to be protected. Depending upon the application, their lengths may be from a few centimeters to several meters. Lengths from approximately 10 cm to approximately 5 m are anticipated. The diameter of the tube will typically be an extremely small fraction of its length (e.g., about 0.9 cm, with approximately 0.5–2.0 cm likely to cover most applications).

Upon triggering of the initiator, the explosion of the initiator's charge ignites the upstream cord end 60A. This in turn, causes a deflagration of the explosive 64 propagating from the upstream end 60A to the downstream end 60B. The deflagrating explosive 64 may combust the sheath 62 or may be vented through apertures (not shown) in the sheath. As the deflagrating front moves along the cord 60 within the tube 30, it induces local ignition of the primary generant 28 located in the annular space between the outer surface of the sheath 62 and the inner surface of the tube 30.

Examples of primary suppressants can be a liquid or solid propellants; these candidates will generate primarily a blend of inert gases (e.g., $CO_2$, $N_2$, and $H_2O$ vapor) by the combustion of their constituents. These can suppress fire by a combination of inerting, thermal, radical interaction, and flame destabilization mechanisms. Combustion of the primary suppressant 28 generates a high volume of the inert gases that ruptures the tube 30 and fills the space to suppress the fire or explosion. The primary suppressant 28 will typically combust over a relatively short time interval. To prevent reignition, a secondary suppressant, or sustainer, is provided to combust over a relatively longer interval. The gas generated from combustion of the sustainer may be vented from the housing through the ferrule or through initially sealed apertures (not shown).

The length of the time intervals over which the primary suppressant and the sustainer suppressant are combusted may be selected for the particular application. The beginning of the latter interval may also be delayed relative to the beginning of the former. Additionally, the total amount of gas generated by respective combustion of the primary and sustainer suppressant may be tailored to the particular application. By way of example: the first (suppressant generation) interval may have a length of about 10–200 ms: the second (sustaining) interval may have a length of about 0.5–7.0 seconds and its beginning may not necessarily be offset from the beginning of the first interval; and the molar amount of gas produced by combustion of the sustainer suppressant may be approximately one to ten times that produced by combustion of the primary suppressant (with a negligible to small contribution from the combustion of the cord 50). The selection of the absolute and relative amounts of gas to be generated by the primary and sustainer suppressant as well as the required intervals are expected to be optimized for any particular use, based upon the myriad of factors presented by the particular use.

Examples of primary liquid suppressants/propellants include hydroxylammonium nitrate (HAN) blends. Examples of primary solid suppressants/propellants include granular blends of, e.g., a powder fuel, a powder oxidizer, and a powder coolant such as disclosed in the U.S. Pat. No. 5,609,210 of Galbraith et al., the disclosure of which is incorporated herein by reference as if set forth at length. Other potentially useful propellants are disclosed in U.S. Pat. No. 6,123,790 of Lundstrom et al., the disclosure of which is incorporated by reference herein as if set forth at length. Another alternative combination involves a loose nitrocellulose as the primary gas generating propellant with a compacted cellulose/nitrocellulose composite sustainer suppressant. These propellant compositions can obtain increased effectiveness by co-blending active agents that can be produced in solid combustion products, including potassium iodide and potassium carbonate.

The primary agent discharge also ignites the secondary agent. Secondary agent ignition can be simultaneous or follow primary agent dispersal. The secondary agent typically has a slower discharge time than the primary agent. For example, the primary agent typically acts and extinguishes the fire in 10 to 200 ms. The secondary agent may function for up to several seconds. By extending the function time, the secondary agent prevents reignition in the fire zone area.

The secondary charge agent can be an inerting, active, or thermal fire suppressant agent. It is combustible and provides inerting or suppressing effects after primary agent has been dispersed and extinguishes fire. It can be granular, cylindrical, monolithic, or multiple grain form. It can use an inerting type mechanism by primarily generating $CO_2$, $N_2$, and water vapor. Alternatives include the addition of an active ingredient such as potassium iodide or potassium carbonate.

Exemplary sustainer suppressant is preferably formed by extrusion and cut to length forming upstream and downstream annular ends of the sustainer. The sustainer composition should be easy to ignite at low pressure (14.7 to 100 psia (0.10 to 0.69 MPa)) and exhibit a relatively low pressure exponent (<0.7). Examples of suitable propellants include an ammonium perchlorate/potassium nitrate type composition (APJKN) formulations and air bag propellant formulations that have been modified with a suitable burn rate catalyst. Certain potentially useful propellants including compression molded mixtures of a powder fuel, a powder oxidizer, and a powder coolant such as disclosed in the U.S. Pat. No. 5,609,210 of Galbraith et al., the disclosure of which is incorporated herein by reference as if set forth at length. Other potentially useful propellants are disclosed in U.S. Pat. No. 6,123,790 of Lundstrom et al., the disclosure of which is incorporated by reference herein as if set forth at length. A preferred sustainer should exhibit relatively long burn times (e.g., 0.15 or 0.25 to 5 or 10 seconds) at pressure ranging from 14.7 psia to 200 psia (0.10 MPa to 1.4 MPa).

Other sustainer configurations are possible. For example, the sustainer may be formed as a coating on the interior surface of the housing. As an alternative to a single extruded-to-length sustainer piece or "grain", the sustainer may be formed of multiple pieces. For example, the sustainer may be formed as a stack of compressed, molded, or extruded, centrally apertured, sustainer disks. The number of disks, and thus the length of the stack, would be selected as appropriate for the intended application.

FIG. 2 shows an alternate embodiment 100 of an apparatus in large part similar or identical to the apparatus of FIG. 1. A key difference is that the illustrated apparatus 100 omits the sustainer within the housing, as well as the associated volume of housing, and the sustainer support rings. Also, the initiator may be of reduced charge as the initiator charge cup may be in relative close facing proximity to the upstream propagation member end. A further difference is the location of a sustainer 102 in a distal (downstream) portion of the tube. In the illustrated embodiment, the sustainer 102 is formed approximately as a cylinder (e.g., pressed, molded, or extruded) having an upstream end proximate a downstream end of the propagation member and a downstream end proximate the downstream end of the tube. In the generator 100, the sustainer 102 may be ignited by the propagating member and/or the main propellant, rather than directly by the initiator. Advantageously, the tube is provided with sufficient robustness so that its rupturing via the combustion of the propagating member and main propellant does not sever a distal portion of the tube from a proximal portion that remains attached to the housing. Advantageously, longitudinally-extending ruptures permit venting of the combustion gases while retaining the sustainer sufficiently to allow the sustainer to be ignited and combust over the sustaining interval. The tube may also be provided with preferential rupture zones such as reduced-thickness relieved areas.

In other alternate embodiments of a gas generator (not shown) the propagating member may be formed by a length of detcord, the upstream end of which is held by the initiator housing. The output of the initiator may not be capable of directly igniting the explosive charge (e.g., PETN or a PETN/RDX mixture) of the detcord. In this case intervening high explosive transfer charge may be provided. The transfer charge is ignited by the output of the initiator and in turn is effective to ignite the detcord. The use of detcord may present cost advantages relative to use of RDC or other material. The speed of explosive propagation of detcord may provide a high degree of simultaneity of ignition in a body of generant dispersed along the detcord.

Figure 3:
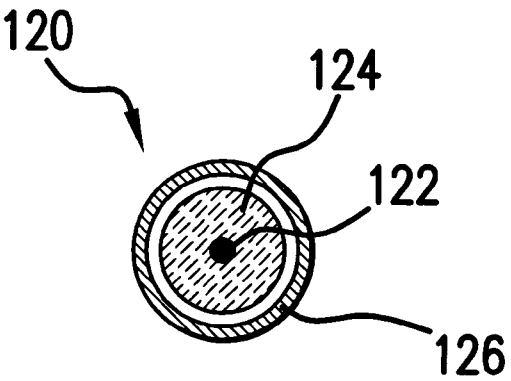
FIG. 3 is a transverse cross-sectional view of an ITLX-type ignition cord useful in the extinguisher of FIG. 1.

FIG. 3 shows an alternate propagating member 120 comprising a central tensile reinforcement 122 (e.g., a fiberglass strand) surrounded by a pyrotechnic cord 124, which, in turn, is surrounded by a flexible jacket 126 (e.g., of polypropylene).

Figure 4:
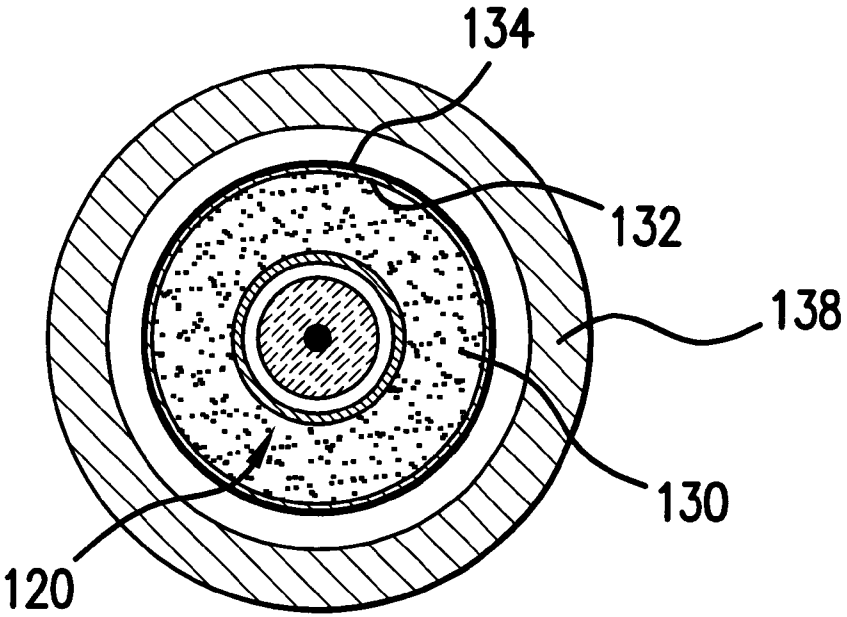
FIG. 4 is a transverse sectional view of a third extinguisher.

FIG. 4 shows an alternate extinguisher in which the propagating member 120 is surrounded by a primary suppressant/propellant 130, which may be similar to propellant 28. The propellant is, in turn, enclosed within a two-layer sheath having an inner fiber layer 132 (e.g., of 0.25 cm thick polypropylene) and an outer coating layer 134 (e.g., of 0.05 cm thick EVA). This in turn is itself contained within an outer elongate flexible member 138, which may be similar to member 30.

Figure 5:
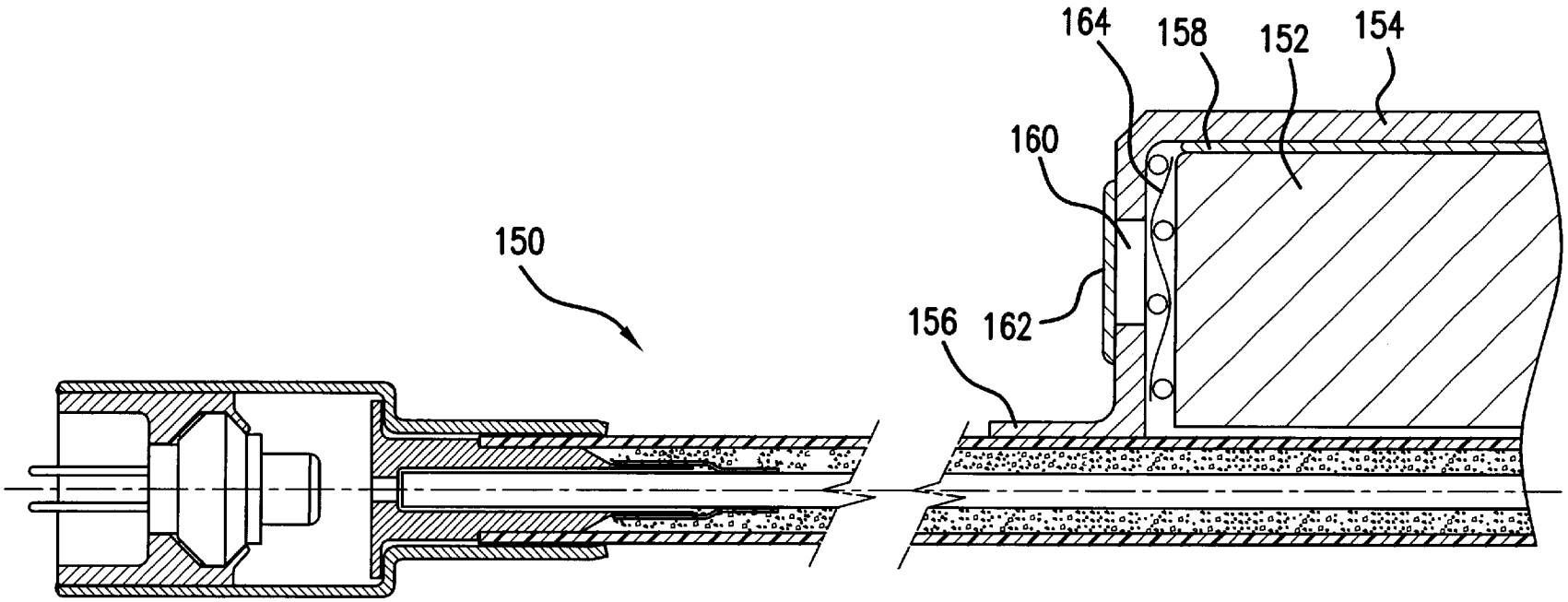
FIG. 5 is a longitudinal sectional view of a fourth extinguisher.

FIG. 5 shows an alternate extinguisher 150, which may be generally similar, for example, to the extinguisher 100 however having a sustainer propellant 152 contained in a rigid metallic canister 154 mounted at a location along the elongate flexible member. The canister will typically occupy a very small portion of the length of the apparatus. For example, it may be located surrounding a distal end of the ignition cord or may be in an intermediate location. The exemplary canister has a boss 156 sealingly secured to the elongate flexible member. A buffer pad 158 holds the sustainer 152 within the sidewall of the canister. One or both end flanges of the canister may be formed with a plurality of apertures 160 initially covered by a seal 162 (e.g., of aluminized film or foil). A screen 164 stands the end of the sustainer off from the end flange of the canister. The ignition cord ignites a solid propellant that combusts and generates gas very rapidly. The propellant is contained in a plastic housing or tube. The housing/tube can be of an elastomeric or metal material and can be flexible or rigid. It can be designed to rupture along the length preferentially by the addition of one or more a scores or stress risers. Its cross section can be cylindrical or a variant shape. Its length can be from several inches to several feet. Upon reaching the rupture pressure of the housing the plastic ruptures and exhausts the combustion products rapidly into the fire zone. The rapid expulsion of gas into the fire zone extinguishes the fire. Because the expulsion in the fire zone occurs so rapidly (10 ms to 200 ms) the fire extinguishment mechanism is enhanced by flame destabilization in addition to $O_2$ depletion and active agent combustion retardation. This results in effective extinguishment with less agent. Examples of primary propellant candidates include nitrocellulose/$KNO_3$ blends.

Figure 6:
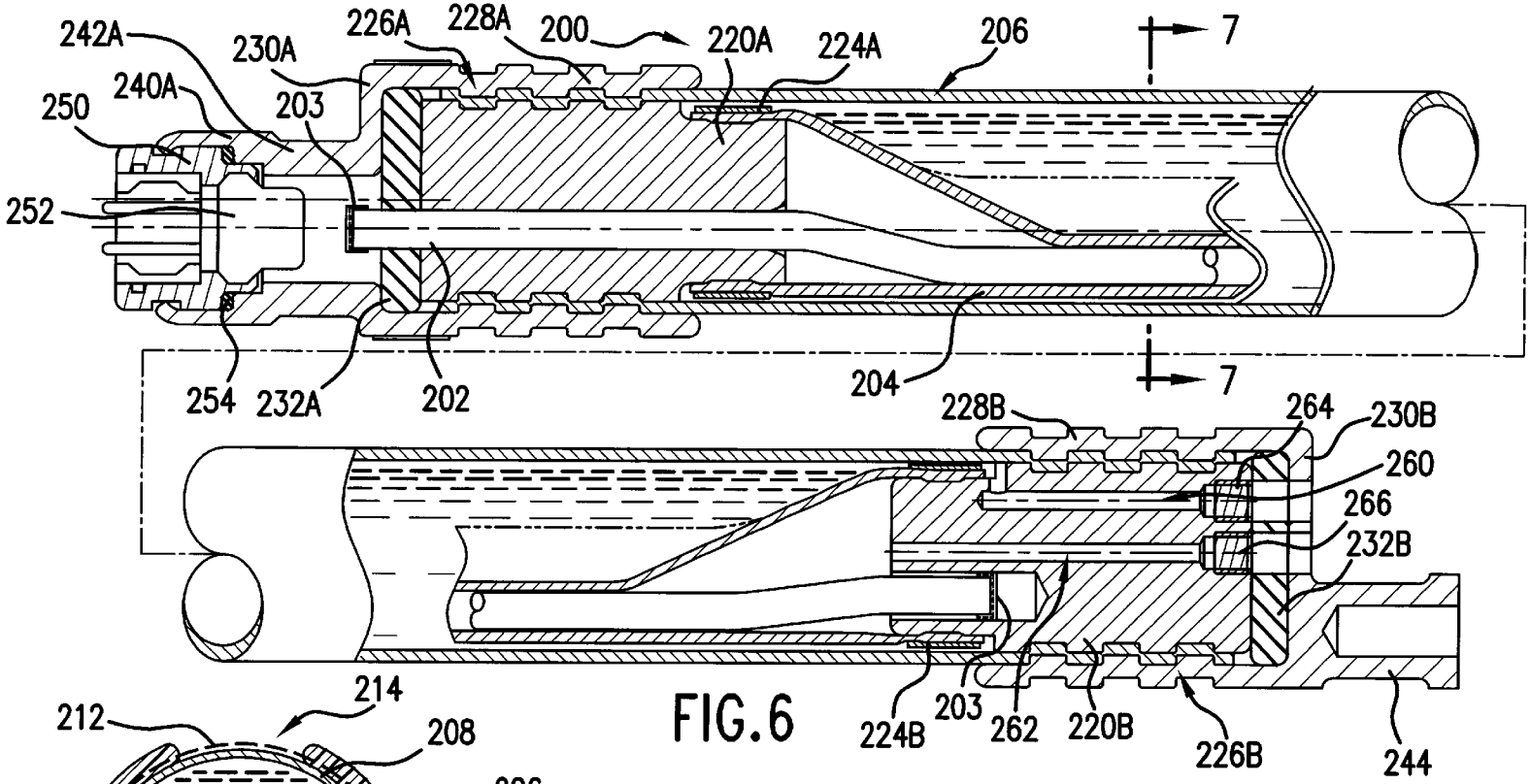
FIG. 6 is a longitudinal sectional view of a fifth extinguisher.
Figure 7:
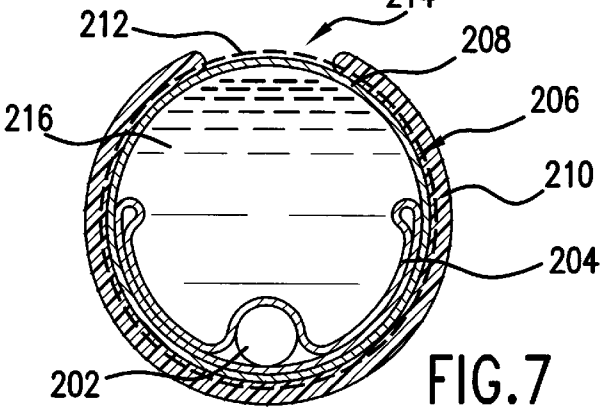
FIG. 7 is a transverse sectional view of the extinguisher of FIG. 6 showing further details.

FIGS. 6–12 show a variety of extinguisher embodiments in which a liquid agent or the like is driven from the extinguisher by inflation of an inflatable member within the extinguisher. This may be in distinction to use of combustion gas alone as a suppressant or driving a liquid suppressant from the extinguisher as an entrainment within a flow of gas. FIG. 6 shows an extinguisher 200 having a propagating member 202 (e.g., of ITLX). Upstream and downstream ends of the propagating member are sealed/covered to prevent the ITLX strands from migrating under dynamic loading. By way of example, this may be achieved via acrylic or nitrocellulose cement caps 203. Along a major portion of its length, the propagating member runs immediately within an initially-collapsed flexible tube or sleeve 204 (e.g., of a fabric-reinforced elastomer such as aramid fiber-reinforced nitrile rubber). This member, to a roughly similar longitudinal extent, lies within an outer tubular structure 206. FIG. 7 shows further details of the tubular structure 206 as comprising a circumferentially continuous liner 208 formed as an elastomeric (e.g., of nitrile rubber or neoprene) tube. The liner 208 lies immediately within an outer flexible jacket 210 having a circumferential reinforcing mesh 212. This reinforced jacket may be generally similar to any of a number of common or other hose constructions. An exemplary jacket material is extruded polyester of 1.5 inch O.D. whereas an exemplary mesh is stainless steel. A key size range for the jacket is 1.0–2.5 inches in O.D. and 2 feet to 10 yards long. The jacket 210, along its circumferential extent, advantageously includes one or more reduced thickness areas 214 that define the ultimate extinguisher outlet. Exemplary area 214 is a longitudinal slot extending entirely through the jacket 210 along the entire or nearly the entire length of the jacket. The mesh is, however, advantageously continuous across this slot to provide hoop strength integrity. A liquid suppressant 216 is advantageously contained between the liner 208 and the inner sleeve 204.

At upstream and downstream ends of the extinguisher, the propagating member 202 is held by crimp blocks 220A and 220B, respectively. Upstream and downstream ends of the inner sleeve 204 receive respective inboard ends of the upstream and downstream crimp blocks and are secured thereto via metallic crimp rings 224A and 224B, respectively. Upstream and downstream ends of the structure 206 surround outboard portions of the upstream and downstream crimp blocks and are secured thereto via crimped end blocks 226A and 226B, respectively. The respective end blocks have sleeves 228A and 228B for crimping to the ends of the structure 206 and have flanges 230A and 230B. Buffer blocks 232A and 232B are located between the flanges and the respective upstream and downstream ends of the respective upstream and downstream crimp blocks. A neck portion 240A of the upstream end block carries an initiator closure 250, which, in turn, carries an initiator 252. An O-ring 254 seals the closure to the neck. A reduced thickness proximal root portion 242A of the neck 240A can accommodate a strap to secure upstream end block to environmental structure. For ease of mounting and stability, the neck is advantageously offset away from the reduced thickness areas 214 so as to be proximate the mounting structure. In a similar fashion, the downstream end block is provided with a hold down lug 244 similarly offset from the center line of the jacket for receiving a hold down strap (not shown). A pair of channels 260 and 262 extend through the downstream crimp block and are in respective communication with: the space between the structure 206 and the sleeve 204; and the space between the sleeve 204 and the propagating member 202. These are sealed via threaded plugs 264 and 266 and may be aligned with corresponding apertures in the flange 230B and buffer block 232B.

In an exemplary assembly sequence the sleeve 204 is secured over the downstream end block 220B via the associated crimp ring. The propagating member is then inserted therein. This subassembly is then inserted into the preassembled tube 206. The propagating member is then inserted into the upstream end block 220A and sleeve 204 secured thereto via the associated clamp ring. The upstream end is then inserted into the tube 206. The upstream buffer pad 232A is placed in the crimp block 230A which is in turn placed over the upstream end of the tube 206 and crimped thereto. The sleeve 204 is then evacuated via the channel 262 and the channel then sealed by the plug 266. The assembly is placed downstream end up and suppressant is then introduced via the channel 260, which is then sealed by the plug 264. The downstream buffer pad 232B is placed in the crimp block 230B which is in turn placed over the downstream end of the tube 206 and crimped thereto. The assembly is checked for leaks. The initiator 252 is sealed in the closure 250 and assembled with the seal 254 and a shorting clip and leak checked this initiator subassembly is then inserted into boss 240A and crimped.

The assembled extinguisher may be formed to accommodate its physical environment and the suppression needs. For example, it may conform to a bulkhead, fuselage surface, or other nonplanar mounting surface. As needs dictate, it may be convoluted so as to provide a higher localized suppression.

In operation, the initiator ignites the propagating member. Gases evolved from the propagating member tend to inflate the sleeve 204. This inflation increases the pressure within the structure 206 until a rupture threshold is reached. In the exemplary embodiment of FIGS. 6 and 7, the rupturing may be of portions of the liner 206 through the exposed mesh 212 at an exemplary threshold pressure of between 900 psig and 1800 psig. Further expansion drives substantially all the suppressant 216 out through the area(s) 214. In various embodiments where the area(s) 214 do not initially extend entirely through jacket, the rupturing may be of the jacket material along these areas in the absence or in addition to rupturing of a separate liner. Advantageously, the total charge in the propagating member is such that its ignition fully inflates the sleeve 204 to substantially fill the structure 206 without itself rupturing. In this fashion, the hot gases evolved by ignition can be contained, substantially limiting discharge to the suppressant 216. It is for this reason that the sleeve is advantageously a fiber-reinforced elastomer.

Figure 8:
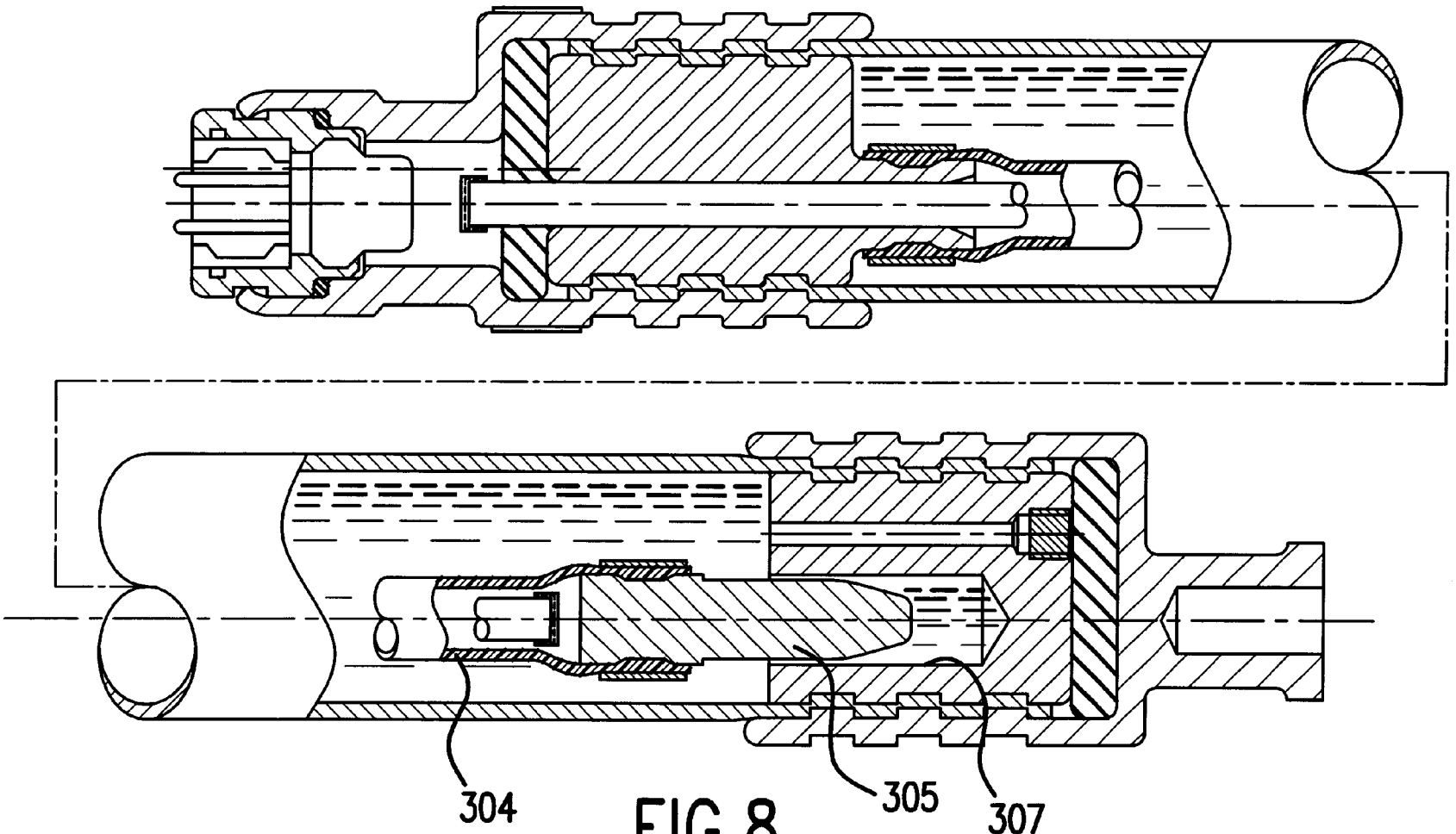
FIG. 8 is a longitudinal sectional view of a sixth extinguisher.

FIG. 8 shows an extinguisher which may be generally similar to that of FIGS. 6 and 7. However, the deflated inflatable sleeve of FIGS. 6 and 7 is replaced by a much smaller diameter tube 304 which is inflatable via stretching. The exemplary tube has an initial inner diameter slightly larger than the outer diameter of the propagating member. Its upstream end is crimped to the upstream crimp block. Its downstream end is crimped to a metal plug 305 which, in turn, is freely received by a bore 307 the downstream crimp end block in sliding engagement to allow differential thermal expansion. Other details of operation may be substantially the same as with the extinguisher of FIGS. 6 and 7. The exemplary expansion tube is formed of polyethylene. In a variation on the extinguisher of FIG. 8, the expansion tube may be designed to rupture so that a mixture of liquid suppressant and combustion gases is discharged.

Figure 9:
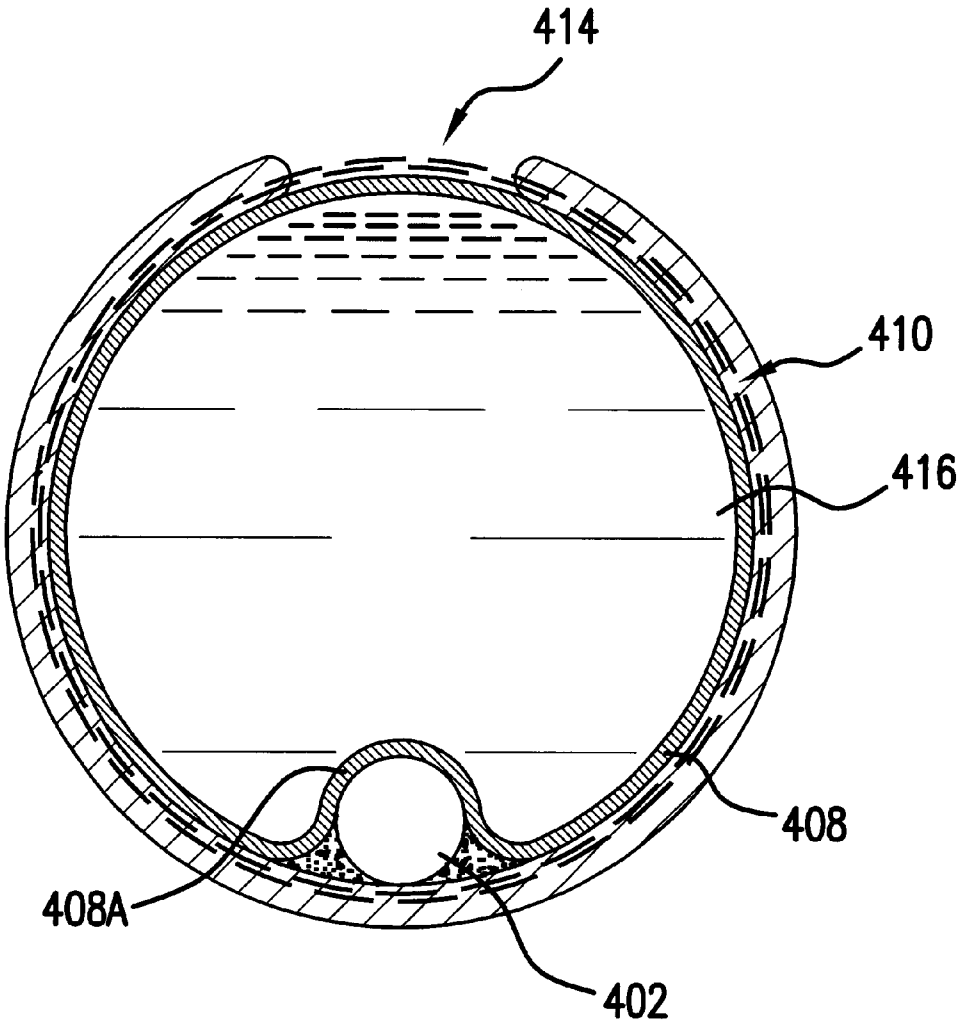
FIG. 9 is a transverse sectional view of a seventh extinguisher.

FIG. 9 shows another exemplary construction similar to that of FIGS. 6 and 7 but wherein the separate liner and sleeves are eliminated. In this embodiment, the ignition cord propagating member 402 is within the jacket 410 but outside the liner 408. It may be secured to the jacket such as via epoxy or other adhesive. The ignition cord is diametrically opposite the outlet 414 and its ignition drives the adjacent portion of the liner toward the outlet, compressing the suppressant 416 within the liner until the threshold pressure is reached, thereby rupturing the liner at the outlet and discharging the suppressant. The combustion parameters may be such that, by the time the portion 408A of the liner formerly adjacent the cord reaches the outlet, the pressure is no longer sufficient to rupture such portion and such portion ends up sealing the outlet so as to contain the combustion gases within the jacket.

Figure 10:
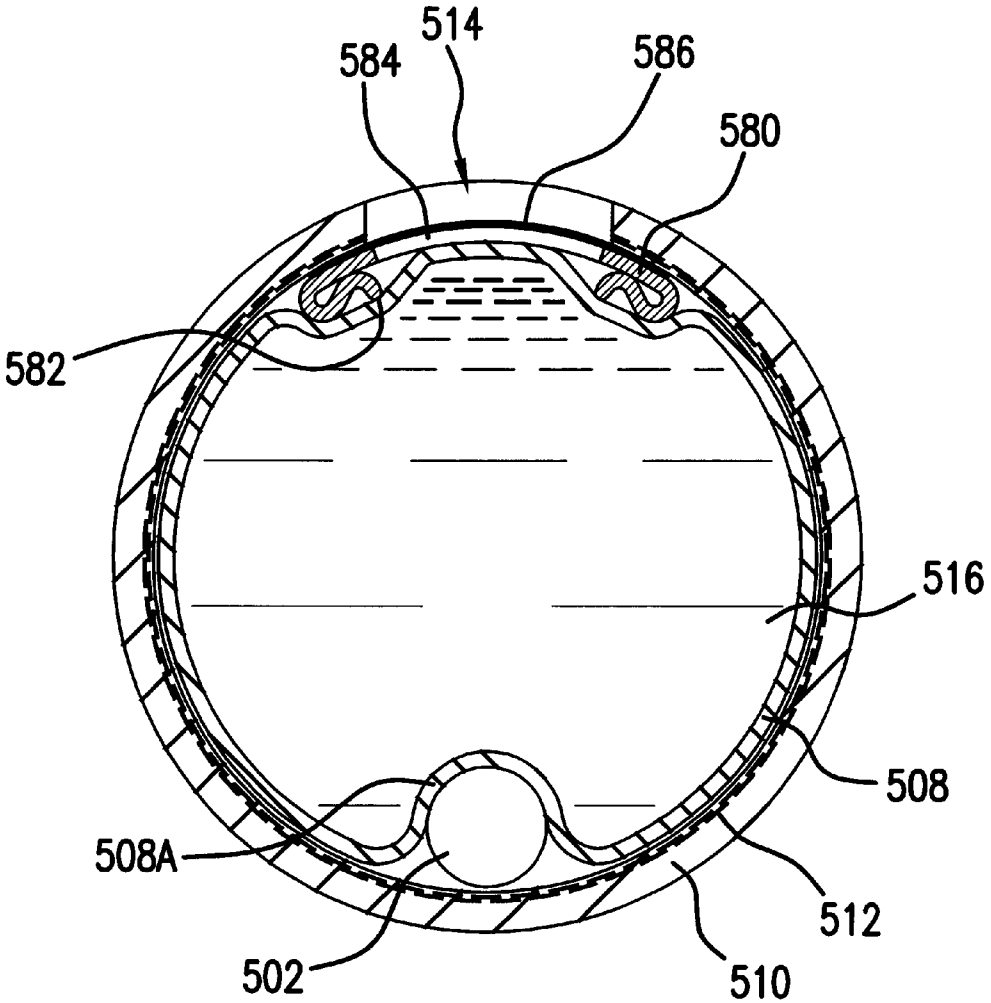
FIG. 10 is a transverse sectional view of an eighth extinguisher.

FIG. 10 shows several variations on the foregoing theme. The liner 508 may be arranged generally similarly to that of FIG. 9. The exemplary liner may be substantially stronger such as being fabric-reinforced. To induce rupturing of this stronger liner, a puncture strip 580 may extend along the hose adjacent the outlet(s) 514. The puncture strip has inwardly folded sharpened edge portions 582. The puncture strip has an array of apertures 584 (e.g., 0.5 inch diameter holes arrayed one inch on center). Complementary holes extend through both the jacket 510 and mesh 512 of the hose. To provide the hoop strength lost by the mesh, the puncture strip may be riveted in place along either side of the array of holes. For improved dispersion, a mesh strip 586 may be sandwiched between the puncture strip and the hose. Upon ignition and pressurization, the portions of the liner contacting the edges of the puncture strip are biased sufficiently against the edges to induce rupturing and permit expulsion of the suppressant 516. By the time the liner portion 508A which was initially adjacent the propagating member 502 reaches the outlet, the reduced pressure, along with cushioning provided by the portions of the liner adjacent the ruptures, prevents this portion from rupturing, thereby sealing the combustion gases within the hose. For such a construction, a relatively high threshold rupture pressure is envisioned (e.g., between 1800 psig and 3000 psig).

Figure 11:
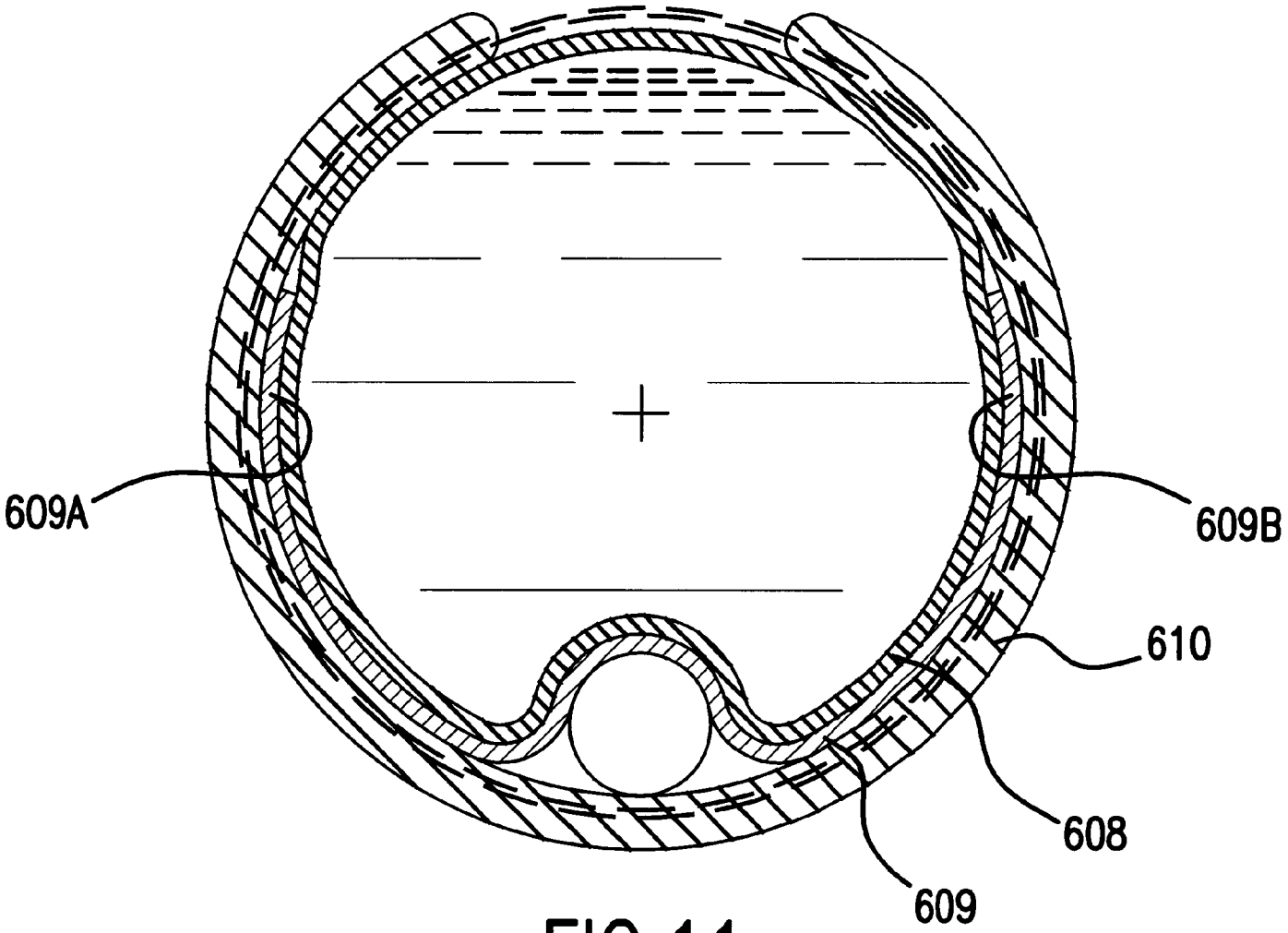
FIG. 11 is a transverse sectional view of a ninth extinguisher.

FIG. 11 is another variation in which the liner 608 is reinforced along only a portion of its circumferential extent (e.g. along slightly more than the half of the circumference on the propagating member side). This reinforcement 609 further prevents the combustion gases from rupturing the liner when the suppressant is discharged. An exemplary reinforcement is an aramid fiber sheet having its edge portions 609A and 609B bonded to the jacket 610 interior surface (e.g., via epoxy) to help contain combustion gases.

Figure 12:
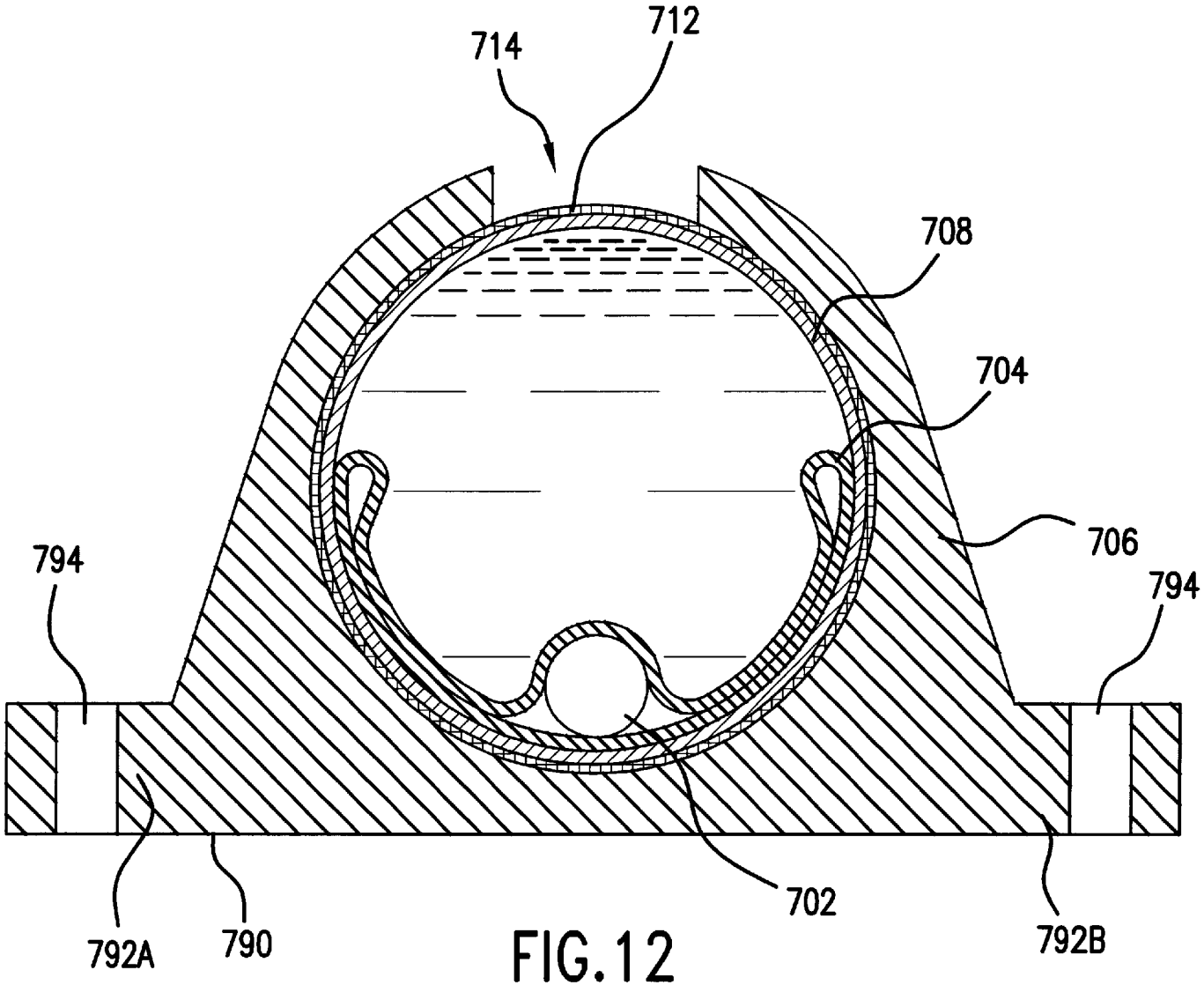
FIG. 12 is a transverse sectional view of a tenth extinguisher.

FIG. 12 shows an extinguisher in which the hose is replaced by a flexible housing 706 (e.g. a molded polyurethane, 80 durometer A-scale). The housing contains a mesh sleeve which in turn contains a liner or burst membrane 708. The liner in turn contains the suppressant and a deflated sleeve 704 containing the propagating member. The liner and sleeve may be similar to those of FIGS. 6 and 7. Opposite the ignition cord 702, the housing has an outlet in the form of an aperture array or an elongate slot 714. Opposite this (behind the propagating member) the housing has an initially flat mounting surface 790 with mounting ears 792A and 792B extending away from the housing body at opposite sides and having mounting apertures 794 for accommodating fasteners (e.g., screws (not shown)). Installation and operation may be generally similar to that of the extinguisher of FIGS. 6 and 7. The housing is conformed to the mounting surface and secured thereto via the fasteners. This mounting arrangement will likely offer somewhat less flexibility than that of the extinguisher of FIGS. 6 and 7 but may provide a more robust and durable arrangement.

The tubular fire extinguisher may provide rapid integration into complex shapes and equipment spaces. No special nozzles or application plumbing are necessarily required. Quick (150 ms) and uniform deployment of the fire suppression agent may be provided due to the linear expelling charge running substantially the full length of the discharging tube and within the suppressant volume. The extinguisher by means of aqueous agents may be safe to discharge directly on humans within the limitation of reasonable offset, e.g., 1.0 foot or 300 mm. Preferably, no pressure is stored within the unit, except those generated by G forces or fluid weights. The main containment may be provided by a polymer plastic tube selected to rupture in the correct range, e.g., 500–1000 psi. This approach will significantly reduce human risk, ease integration and achieve high overall effectiveness over a wide range of agent loads and types, e.g., from ½–6.0 Ibm. (0.2–2.75 kg). The discharge may be through a single aperture or an array of apertures extending along a given length of the housing. The apertures may be preformed in various ways and to various degrees. Advantageously, the length along which the aperture or aperture array extends is a majority of the length of the extinguisher. Depending on the suppressant used, and other details of the particular implementation, the individual apertures in the array may occupy but a small fraction of the array length.

Various modifications are possible:

1. Among fluorocarbon suppression agents are: $CF_3I$ (trifluoroiodomethane); HFC-125 (pentafluoroethane); HFC-227 (heptafluopropane); perfluorobutane; perfluorohexane; methyl nonafluorobutyl ether; and/or similar commercial products.
2. Among dry chemical powder suppression agents are: potassium bicarbonate (e.g., PURPLE-K siliconized potassium bicarbonate or MONNEX potassium bicarbonate-urea complex); sodium bicarbonate; monoammonium phosphate (MAP), potassium polyphosphates; sodium carbonate; potassium carbonate; sodium chloride; potassium iodide; aluminum oxide; and/or ammonium sulfate.
3. Liquid suppression agents using aqueous mixture of surfactants or sodium/potassium salts or admixtures in combination may be deployed such as: nonionic surfactants(e.g., pluronic polyols); anionic surfactants (e.g., fatty alcohol ether sulfates such as sodium lauryl sulfate); perfluoro-octanoic acid; cationic surfactants (e.g., n-dodecyltrimethylammonium chloride or cetyltrimethylammonium chloride); fire suppressing additives (e.g., potassium lactate, potassium acetate, potassium halides, ammonium phosphates and polyphosphates); antifreeze additives (e.g., $CaCl_2$ or proteins); foaming additives; thickeners (e.g., guar gum, attapulgite clay); long chain alcohols (e.g., hexylene glycol, n-butyl alcohol, and butanol); and/or corrosion inhibitors.
4. The extinguisher may be of duplex ignition, and configured initiate only a partial length, to provide a secondary or timed dispersal into the fire.
5. The extinguisher body length can be adjusted to fit application or the extinguisher may be configured as a closed hoop.
6. The extinguisher can be integrated around heat rise detectors or ionization chambers to form fully integrated systems.
7. Extinguishers may be integrated together to form a network or grid pattern to protect assets over a large area.
8. The extinguisher may be coiled to provide a more localized point source.
9. Dyes or markers may be introduced into suppressant agents to show their effect on protected assets.
10. Sensors using the electrovalence of metallic elements to salts in solution in a form to detect heat rise may be employed.
11. Microelectronic voltage amplifiers may be employed to measure heat rise or electrolytic condition of agents in situ to main tube containment.

One or more embodiments of the present invention have been described. Nevertheless, it will be understood that various modifications may be made without departing from the spirit and scope of the invention. For example, various forms and compositions of primary and sustainer generants may be utilized. Pellets and disks of compacted, molded, or extruded generants are desirable for the sustainer generant as are single grain forms due to the reduced combustion rate. Additionally, many of the details of the generator may be optimized for the particular inflation or other application with which it is intended to be used. Accordingly, other embodiments are within the scope of the following claims.

What is claimed is:

1. A fire suppression system, comprising:

an elongate ignition cord;

an initial gas generant, initially surrounding the ignition cord; and an initiator;

a housing having upstream and downstream ends and an interior space and wherein the initiator is mounted in the upstream housing end; and a sustainer gas generant;

wherein:

the initiator is positioned to, upon triggering, cause ignition of the gas generant so that the gas generant combusts over a first time interval so as to generate gas in a sufficient amount to substantially extinguish a fire; and the initiator is positioned to, upon triggering, cause ignition of the sustainer gas generant so that the sustainer gas generant combusts over a second time interval, ending after an end of the first time interval, so as to generate sustainer gas in a sufficient amount to substantially prevent reignition of the fire.

2. The system of claim 1 wherein:

the first interval has a length of less than 0.50 second; and the second interval has a length of at least 2.0 seconds.

3. The system of claim 1 wherein:

the first interval has a length of less than 0.20 second; and the second interval has a length of at least 3.0 seconds.

4. The system of claim 1 wherein the sustainer gas generant is formed as at least one annulus positioned coaxial with the initiator.

5. The system of claim 1 wherein the sustainer gas generant is formed as a single extruded sustainer tube.

6. The system of claim 1 wherein the ignition cord is a rapid deflagrating cord having a sheath and a pyrotechnic charge contained within the sheath.

7. The system of claim 1 further comprising a tube containing the gas generant and having a proximal end secured to the housing.

8. A fire suppression system, comprising:

an elongate extinguisher body comprising a flexible hose having a hose jacket and a mesh sleeve;

an ignition cord extending along a length within the hose; and a suppressant within the hose, wherein ignition of the ignition cord is effective to directly or indirectly expel the suppressant from the extinguisher body in a direction substantially transverse to the length of the ignition cord.

9. The system of claim 8 wherein:

the supressant is contained within a flexible liner, which ruptures to permit said expulsion.

10. The system of claim 9 wherein:

said liner is a first sleeve;

the ignition cord is within a collapsed second sleeve within the first sleeve; and upon said ignition, the collapsed sleeve inflates but does not burst.

11. The system of claim 9 wherein:

said rupturing is of a first portion of the liner adjacent an associated first portion of the mesh sleeve;

the ignition cord is external to the liner, adjacent a second portion thereof, opposite said first portion; and ignition gases from said ignition drive said second portion toward said ruptured first portion so as to seal said first portion of the mesh sleeve.

12. The system of claim 8 wherein:

the jacket has one or more preformed apertures through which said expulsion occurs.

13. The system of claim 12 wherein:

the one or more preformed apertures are formed by removing material from the jacket to expose the mesh.

14. The system of claim 12 wherein:

the one or more apertures extend along a majority of the length of the extinguisher body.

15. The system of claim 12 wherein:

the one or more apertures occupy a majority of the length of the extinguisher body.

16. The system of claim 8 further comprising:

a first end plug sealing a first end of the flexible hose; and a second end plug sealing a second end of the flexible hose.

17. The system of claim 16 further comprising:

a first end block crimped over said first end of the flexible hose; and a second end block crimped over said second end of the flexible hose.

18. The system of claim 17 further comprising:

an initiator carried by the first end block for igniting the ignition cord.

19. The system of claim 16 further comprising:

a flexible liner containing the supressant, which liner ruptures to permit said expulsion, wherein:

the flexible liner has a first end sealed by said first end plug and a second end sealed by said second end plug; and said second end plug has a first port in communication with an interior of said liner and a second port in communication with a space between the hose and the liner.

20. A fire suppression system, comprising:

a flexible elongate extinguisher body capable of being ruptured along an entire length of said extinguisher body;

an ignition cord extending along a length within the extinguisher body; and a suppressant within the body, wherein ignition of the ignition cord is effective to directly or indirectly expel the suppressant from the extinguisher body in a direction substantially transverse to the length of the ignition cord.

21. The system of claim 20 wherein the suppressant consists in major mass part of material selected from the group consisting of: HFC's, monoammonium phosphates and potassium bicarbonates.

22. The system of claim 20 wherein the body has a length of 10 cm to 5 m.

23. The system of claim 20 wherein the body has a nominal O.D. of 1.0 inch to 2.5 inches.

24. The system of claim 20 wherein the expulsion ruptures a sacrificial element at a threshold pressure of between 900 psig and 1800 psig.

25. The system of claim 20 wherein the expulsion ruptures a sacrificial element at a threshold pressure of between 1800 psig and 3000 psig.

26. The system of claim 20 wherein:

the suppressant comprises a liquid;

the expulsion comprises permitting combustion of at least the cord to inflate a member within the extinguisher body;

the inflation produces the expulsion by driving the liquid through an aperture or aperture array extending along a major portion of a length of the extinguisher body.

* * * * *